US005503503A

United States Patent [19]

Glass et al.

[11] Patent Number: 5,503,503

[45] Date of Patent: Apr. 2, 1996

[54] METHOD AND APPARATUS FOR INSERTING SHEET PILES WITHIN AN EARTH FORMATION

[76] Inventors: James O. Glass; Sam M. Glass, both of Rte. 2, Box 32, Anahuae, Tex. 77514

[21] Appl. No.: 312,775

[22] Filed: Sep. 27, 1994

[51] Int. Cl.[6] ..... E02D 7/26

[52] U.S. Cl. ..... 405/274; 405/279

[58] Field of Search ..... 405/274, 276, 405/279; 175/171

[56] References Cited

U.S. PATENT DOCUMENTS 4,094,156 6/1978 Dumont ..... 405/274

FOREIGN PATENT DOCUMENTS 580118 1/1932 Germany ..... 405/274

*Primary Examiner*—William P. Neuder

*Attorney, Agent, or Firm*—Bush, Moseley, Riddle & Jackson

[57] ABSTRACT

A method and apparatus for inserting a sheet pile (10) into an earth formation utilizing a protective housing (12) releasably connected to the sheet pile (10). The driving force exerted by a vibrator hammer (58) or drop hammer is applied against the protective housing (12) which in turn applies the driving force against the upper end of the sheet pile (10) for driving the sheet pile (10) into the formation. Movable flaps (28, 29) on the lower end of the housing (12) pivot inwardly to engage the lower end of the sheet pile (10) for releasably connecting the protective housing (12) to the sheet pile (10).

8 Claims, 2 Drawing Sheets

FIG. 4
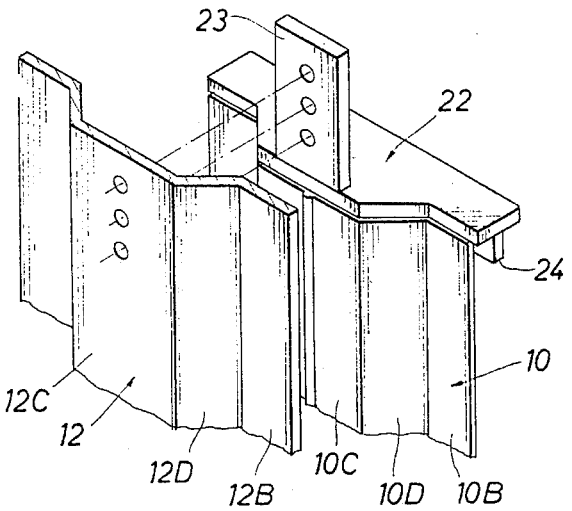
FIG. 7
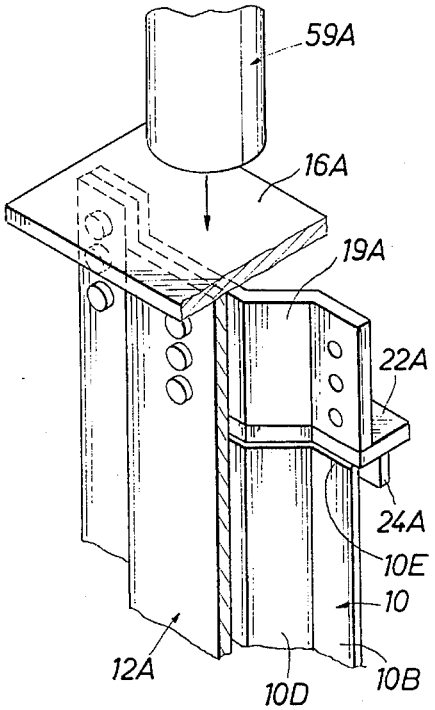
FIG. 5
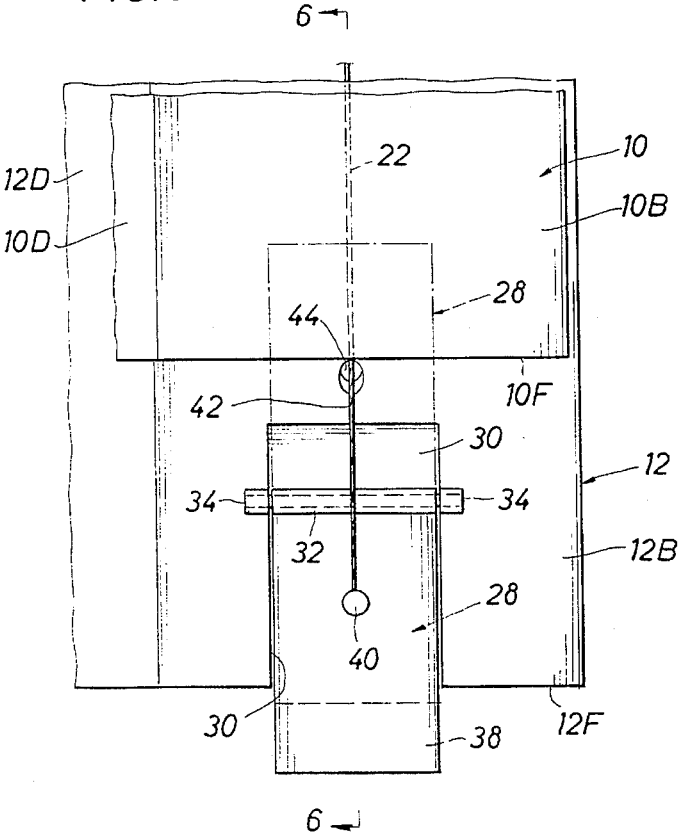
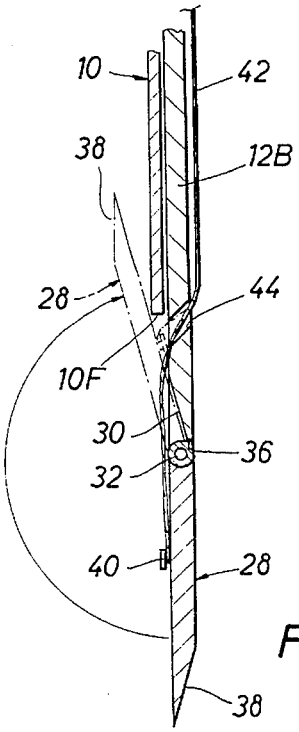
FIG. 6

METHOD AND APPARATUS FOR INSERTING SHEET PILES WITHIN AN EARTH FORMATION

FIELD OF THE INVENTION

This invention relates to a method and apparatus for inserting sheet piles within an earth formation, and more particularly to such a method and apparatus utilizing a separate protective housing or shield for the sheet pile which is inserted within the ground formation with the sheet pile and then withdrawn from the earth formation leaving the sheet pile in place.

BACKGROUND OF THE INVENTION

Sheet piles or piling when driven into the ground, particularly if formed of a non-metallic material or a relatively thin metal material such as aluminum, may become damaged when driven into the ground. Sheet piling for seawalls, for example, may be formed of Z-shaped interlocking sheet piling extruded from special vinyl formulations. Sheet piling formed of a rigid vinyl material is resistant to marine borers, rot, rust, galvanic corrosion, or highly acidic or alkaline soil conditions. Such a vinyl material is inert to a marine environment and will not deteriorate in fresh, brackish, or salt water applications, and will not leak harmful chemicals into the water or soil.

Sheet piling is usually driven or inserted within the soil or earth formation by drop hammers or vibratory hammers. However, under certain conditions, such as low temperature when vinyl sheet piling is brittle, possible damage may occur when the sheet piling is driven or embedded into the soil.

It is an object of the present invention to provide a method and apparatus for driving or inserting a sheet piling within the soil which protects the sheet piling against possible damage.

It is a further object of the present invention to provide such a method and apparatus in which a protective housing or shield is releasably connected to the sheet piling when the sheet piling is being driven or embedded within the soil for transferring impact loads from the force exerting means to the sheet piling until the sheet piling reaches the desired depth.

SUMMARY OF THE INVENTION

The present invention is directed to a method and apparatus for protecting a sheet piling during driving or insertion of the sheet piling within the soil or earth formation. A protective housing or shield preferably formed of metal having a cross section generally similar to the cross section of the sheet piling is adapted to be releasably connected to the sheet piling for simultaneous movement with the sheet piling.

The housing has retaining members adjacent its lower end for releasably connecting the sheet piling to the housing for movement therewith. At least some of the retaining members are mounted for movement between engaged and disengaged positions relative to the sheet piling. The housing is of a length greater than the length of the sheet piling and a generally horizontal force exerting member on the housing extends over the upper end of the sheet piling when the sheet piling and housing are connected for exerting a driving force against the upper end of filing from a vibratory hammer or drop hammer on the housing. The housing and connected sheet piling are driven downwardly into the soil together to a desired depth. Then, the housing is lifted upwardly for removal leaving the sheet piling in place.

Such a protective housing or shield for the sheet piling, particularly sheet piling formed of a rigid vinyl or plastic material, minimizes damage to the sheet piling during installation and permits the sheet piling to be easily driven to a desired depth even with large drop hammers. The movable retaining members for releasably connecting the sheet piling to the housing are actuated manually for movement to an engaged position and move to a disengaged position when in embedded relation by upward movement of the housing and within any manual actuation being required.

Other objects, features, and advantages of this invention will become more apparent after referring to the following specification and drawings.

IN THE DRAWINGS

FIG. 4 is an enlarged sectional view taken generally along line 4—4 of FIG. 1 and showing a force exerting member in plan;

FIG. 5 is all elevational view of a releasable retaining member mounted for pivotal movement adjacent the lower end of the protective housing;

FIG. 6 is a sectional view taken generally along line 6—6 of FIG. 5; and FIG. 7 is a perspective of the upper end portion of a modified protective housing of the present invention especially adapted for use with a drop hammer.

DESCRIPTION OF THE INVENTION

Figure 1:
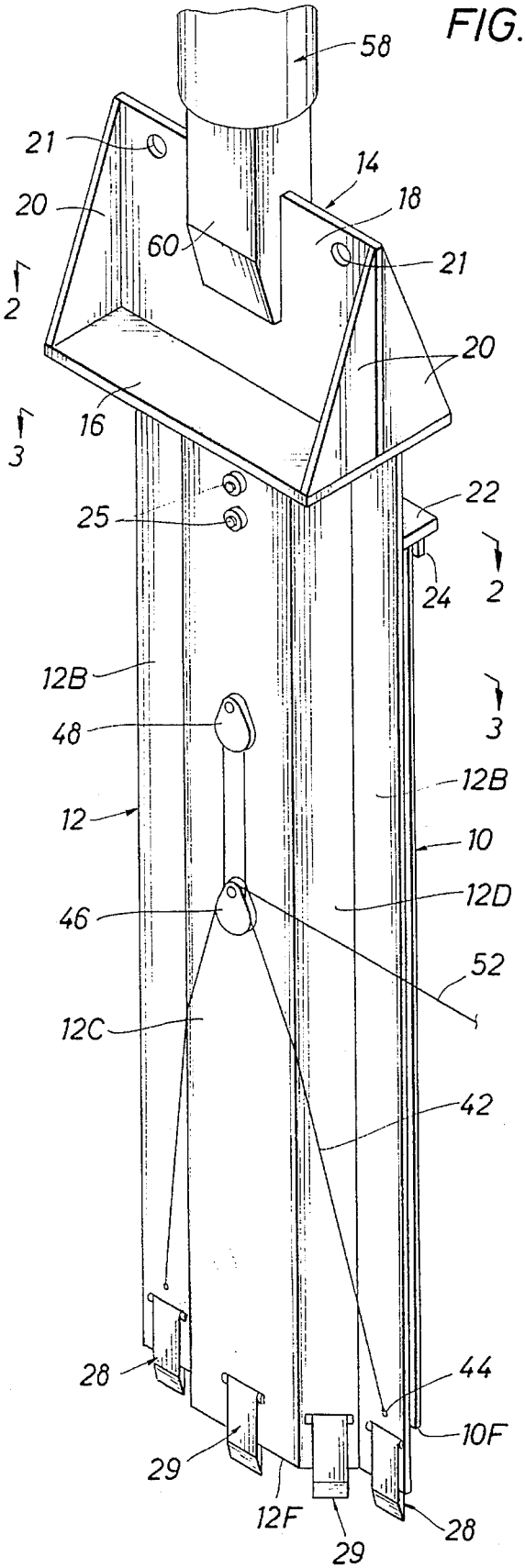
FIG. 1 is a perspective view of one embodiment of the invention showing sheet piling retained by an outer protective housing for movement with the protective housing.
Figure 2:
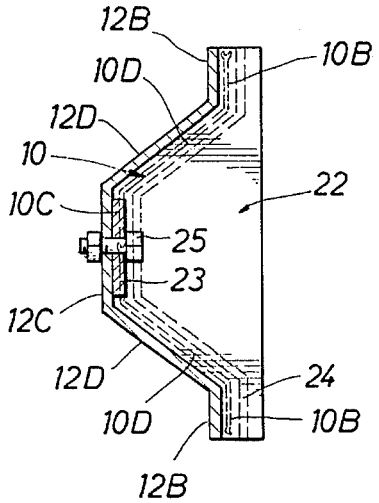
FIG. 2 is an enlarged sectional view taken generally along line 2—2 of FIG. 1.
Figure 3:
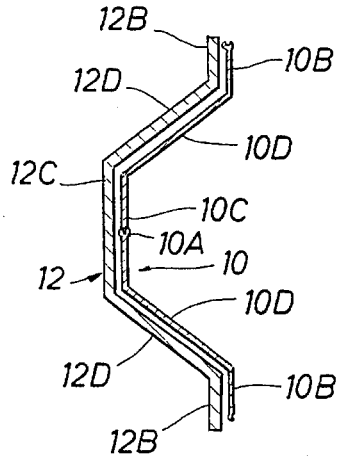
FIG. 3 is a perspective of the upper end portion of the connected sheet piling and the protective housing showing a force exerting member on the housing extending over the upper end of the sheet piling for transferring a driving force to the upper edge of the sheet piling.

Referring now to the embodiment of the invention shown in FIGS. 1–5, a sheet pile or piling is generally at 10. Sheet pile 10 is illustrated as a pair of Z-shaped pile sections which have been previously secured to each other at an interfitting tongue and groove joint 10A. Sheet pile 10 includes side flanges 10B, central body portion 10C, integral connecting portions 10D, tipper end 10E, and a lower end 10F. Sheet pile 10 may be formed of a rigid plastic material such as a rigid vinyl material and it is desired to provide a protective housing or shield generally indicated at 12 releasably connected to pile 10 for being driven with pile 10 into the soil or an earth formation. Housing 12 has a cross section generally similar to the cross section of pile 10 including side flanges 12B, central body portion 12C, integral connecting portions 12D, upper end 12E, and lower end 12F. Protective housing 12 is of a length greater than the length of sheet piling 10 and extends substantially beyond ends 10E and 10F and sheet piling 10.

Secured to the upper end 12E of housing 12 is an upper support bracket generally indicated at 14 including a lower horizontal base 16 and a vertical support plate 18. End reinforcing braces 20 are secured between base 16 and vertical support plate 18. Suitable openings or eyes 21 are provided in plate 18 to receive hooks or the like on the ends of cables from a crane or other overhead lifting means. Secured to housing 12 below upper support bracket 14 is a horizontal force exerting plate 22 adapted to extend over and contact upper end 10E of piling 10 when piling 10 and protective housing 12 are connected together. A downwardly extending retaining lip or extension 24 on force exerting plate 22 extends outwardly of and adjacent sheet piling 10 when releasably connected to protective housing 12 to block outward lateral movement of sheet piling 10 away from housing 12. Lip 23 is of a shape generally similar to the cross sectional shape of sheet piling 10. A hanger plate 23 secured to force exerting plate 22 is bolted at 25 to housing 12.

Mounted on housing 12 adjacent lower end 12F are a plurality of retaining members or flaps including generally similar retaining flaps 28 mounted on flanges 12B and generally similar retaining flaps 29 mounted on central body portion 12C and connecting portions 12D. Flaps 28, 29 are mounted in cut out portions 30 of housing 12 as shown in FIGS. 5 and 6 for flap 28. A pivot axis or shaft 32 secured to the upper end of each flap has ends received within end bearings or sleeves 34 secured to housing 12 to mount the flaps for forward pivotal movement. A stop 36 on shaft 32 engages an adjacent surface on fixed bearing sleeves 34 to block outward pivotal movement of the flaps from the position shown in FIGS. 5 and 6. The lower end of each flap 28, 29 has a slanted or beveled end portion 38 so that contact of end portion 38 with the soil urges the flap inwardly for inward pivotal movement to a position such as shown in FIG. 6.

Flaps 28 on side flanges 12B are mounted for separate manual actuation to an inwardly pivoted relation as shown in broken lines in FIG. 6. For this purpose, each flap 28 has a retaining pin 40 on which the end of a flexible cord 42 is secured. Cord 42 extends through a suitable opening 44 in side flange 12B and is connected to a travelling block 46. An upper support block 48 is secured to housing 12 and connected by cables for supporting lower travelling block 46. A manually actuated cord 52 has an end secured to block 46 and extends about upper block 48 for raising block 46 when cord 52 is pulled manually from its extending end, such as by a workman on the ground or other supporting surface.

In operation, housing 12 is first positioned adjacent sheet pile 10 with the upper end 10E contacting force exerting plate 22 adjacent retaining lip 24, and the lower end 10F of sheet pile 10 above flaps 28. A crane or the like positions housing 12 adjacent sheet pile 10 by lifting housing 12 through eyes 21. In this position, cord 52 is pulled manually to pivot retainer flaps 28 inwardly about the lower end portion of sheet pile 10 to hold pile 10 in releasably connected position with protective housing 12 as shown in the broken line position of FIGS. 5 and 6 so that pile 10 and housing 12 may be transported together to a desired location for insertion of pile 10 into an earth formation.

Upon connection of housing 12 and sheet piling 10 with flaps 28 engaging piling 10, the connected piling 10 and protective housing 12 are transported in vertical relation by a suitable crane or the like having hooks engaging openings or eyes 54 in support plate 18 to the desired location where sheet piling 10 is to be embedded within the soil or earth formation such as the bottom of a body of water, for example. During transport of the connected sheet piling 10 and protected housing 12, tension is maintained manually on flexible cord 52 to hold flaps 28 in retaining relation with the lower end 10F of piling 10. The connected sheet piling 10 and protective housing 12 are lowered to a location at which it is desired to drive sheet piling 10 into the formation. A vibrator hammer generally indicated at 58 is secured by suitable clamps or jaws 60 to support plate 18 and is connected to a suitable source of power. Vibrator hammer 58 is then energized and connected sheet piling 10 and protective housing 12 move downwardly within the formation as a result of a driving force exerted by vibrator hammer 58 and force exerting plate 22 against the upper end 10E of piling 10. After the connected piling 10 and protective housing 12 are initially embedded in the formation to a depth of around 6 (six) inches, cord 52 may be manually released to release the tension in cord 52 as contact with the adjacent soil will maintain retaining flaps 28 in retaining relation with sheet piling 10 as piling 10 and housing 12 are driven downwardly. Flaps 29 upon engagement with the formation are pivoted inwardly of housing 12 as piling 10 moves downwardly for engaging sheet piling 10 in the same manner as retaining flaps 28. Thus, retaining lip 24 and retaining flaps 28 and 29 releasably connect sheet piling 10 to housing 12 for being driven downwardly together. When the connected sheet piling 10 and protective housing 12 reach the desired depth for sheet piling 10, housing 12 is lifted upwardly by a suitable crane or the like and flaps 28, 29 are pivoted downwardly upon engagement with the formation to a vertical relation as shown in FIG. 6 without any manual actuation thereby to permit removal of protective housing 12 from sheet piling 10 leaving piling 10 in place.

FIG. 7 shows an embodiment especially adapted for use with a drop hammer shown at 59A. Upper support bracket 14A includes all upper horizontal plate 16A secured to the upper end of housing 12A. A reinforcing plate 19A extends between plate 16A and force exerting plate 22A for reinforcing the connection between 22A and housing 12A. Suitable bolts 25A connect reenforcing the connection between plate 22A and housing 12A. Suitable bolts 25A connect reenforcing plate 19A to housing 12A. The drop hammer generally shown at 59A exerts a force against plate 16A and force exerting plate 22A in the same manner as the embodiment of FIGS. 1–6 for driving sheet pile 10 downwardly.

From the above, it is apparent that an improved method and apparatus has been provided for the insertion of plastic sheet piling or relatively thin metal sheet piling for protection of the sheet piling as it is driven into the ground or earth formation. The protective housing is first initially connected to the sheet piling and then the connected sheet piling and protective housing are driven downwardly together in the formation to the desired depth. The protective housing may then be lifted upwardly without any further actuation.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. Apparatus for assisting the insertion of a sheet pile within an earth formation comprising:

an outer protective housing of a cross-section generally similar to the cross-section of the sheet pile and adapted to be positioned in a vertical position adjacent one side of said sheet pile for releasable connection to said sheet pile; said protective housing extending vertically above said sheet pile and having a generally horizontally extending force exerting member adapted to extend over the upper end of said sheet pile for contacting the upper end of said pile in a driving relation;

force exerting means attached to said housing for exerting a downwardly directed driving force against said protective housing and thence against the upper end of said sheet pile through said force exerting member for insertion of said sheet pile within the earth formation;

said protective housing extending vertically below said sheet pile; and means on the lower end of said housing below said sheet pile for releasably engaging the lower end of said sheet pile for lifting of said pile and permitting removal of said protective housing from the earth formation and said sheet pile after insertion of said sheet pile.

2. Apparatus as set forth in claim 1 wherein the end of said housing has a plurality of pile retaining flaps pivotally mounted thereon below the lower end of said sheet pile; and means are provided to selectively pivot said pile retaining flaps inwardly from an extended position to a folded position engaging an adjacent surface of said sheet pile to retain said sheet pile for movement with said housing.

3. Apparatus as set forth in claim 1 wherein said generally horizontally extending force exerting member has a sheet pile retaining member extending downwardly alongside and outwardly of said sheet pile to block lateral movement of the upper end of said sheet pile away from said housing when said sheet pile and housing are releasably connected to each other.

4. Apparatus as set forth in claim 1 wherein said housing is formed of metal and said pile is formed of a rigid plastic material.

5. A method for inserting a sheet pile having a generally uniform cross section throughout its length within an earth formation comprising the following steps:

providing a protective housing of a cross section generally similar to the cross section of said sheet pile and of a length greater than the length of said sheet pile;

providing a force exerting member on said metal housing for exerting a force against the upper end of said sheet pile;

providing releasable pile retaining means on said metal housing for releasably retaining said sheet pile adjacent said metal housing during insertion of said sheet pile within the earth formation;

positioning said housing adjacent one side of said sheet pile;

positioning said pile retaining means adjacent said sheet pile and releasably connecting said sheet pile and protective housing together;

moving said connected sheet pile and protective housing in a vertical relation to a location at which said sheet pile is to be inserted within the earth formation;

applying force against said protective housing for moving said protective housing and sheet pile vertically downwardly into the earth formation to a desired depth; and then lifting said protective housing upwardly relative to said sheet pile for removal of said protective housing from said earth formation upon release of said releasable pile retaining means leaving said sheet pile in place within the earth formation.

6. The method as set forth in claim 5 including the step of:

mounting at least some of said pile retaining means for movement between engaged and disengaged positions with said sheet pile.

7. The method as set forth in claim 6 including the step of:

applying force against said protective housing from a vibrator hammer attached to said protective housing.

8. The method as set forth in claim 6 including the step of:

applying force against said protective housing from a fluid actuated drop hammer contacting said metal housing.

* * * * *